US008500103B2

(12) United States Patent
Alberson et al.

(10) Patent No.: US 8,500,103 B2
(45) Date of Patent: Aug. 6, 2013

(54) YIELDING POST GUARDRAIL SAFETY SYSTEM INCORPORATING THRIE BEAM GUARDRAIL ELEMENTS

(75) Inventors: Dean C. Alberson, Bryan, TX (US); Roger P. Bligh, College Station, TX (US); D. Lance Bullard, Jr., College Station, TX (US); C. Eugene Buth, Wellborn, TX (US)

(73) Assignee: The Texas A&M University System, College Station, TX (US)

( * ) Notice: Subject to any disclaimer, the term of this patent is extended or adjusted under 35 U.S.C. 154(b) by 1322 days.

(21) Appl. No.: 11/679,957

(22) Filed: Feb. 28, 2007

(65) Prior Publication Data

US 2007/0215849 A1 Sep. 20, 2007

Related U.S. Application Data

(60) Provisional application No. 60/778,188, filed on Mar. 1, 2006.

(51) Int. Cl.
*E01F 15/00* (2006.01)

(52) U.S. Cl.
USPC ..... 256/13.1

(58) Field of Classification Search
USPC ..... 256/13.1; 404/6
See application file for complete search history.

(56) References Cited

U.S. PATENT DOCUMENTS

| | | | | |
|---|---|---|---|---|
| 1,822,657 A | | 9/1931 | Horton | |
| 2,047,436 A | | 7/1936 | Shepherd | 256/13.1 |
| 2,776,116 A | | 1/1957 | Brickman | 256/13.1 |
| 3,176,808 A | | 4/1965 | Matthews | |
| 3,241,423 A | | 3/1966 | Davis | 411/399 |
| 3,493,213 A | | 2/1970 | Ackerman | 256/13.1 |
| 3,519,249 A | | 7/1970 | Nave | 256/13.1 |
| 4,010,671 A | | 3/1977 | Hubbard et al. | 411/422 |
| 4,138,093 A | | 2/1979 | Meinzer | 256/13.1 |
| 4,330,106 A | * | 5/1982 | Chisholm | 256/13.1 |
| 4,432,172 A | | 2/1984 | Kukendall et al. | 52/98 |
| 4,607,824 A | * | 8/1986 | Krage et al. | 256/13.1 |

(Continued)

FOREIGN PATENT DOCUMENTS

| | | |
|---|---|---|
| WO | WO 98/50637 | 11/1998 |
| WO | WO 03/048460 A1 | 6/2003 |

OTHER PUBLICATIONS

PCT Invitation to Pay Additional Fees from the International Searching Authority, International Application No. PCT/US2006/036402, 5 pages, Aug. 2, 2007.

(Continued)

*Primary Examiner* — Michael P Ferguson
(74) *Attorney, Agent, or Firm* — Baker Botts L.L.P.

(57) ABSTRACT

A guardrail safety system includes a guardrail beam operable to contain and redirect an errant vehicle to prevent the vehicle from leaving a roadway. At least a portion of the guardrail beam includes a thrie beam. A support post is coupled to the guardrail beam and includes a lower portion, a mid portion, and an upper portion. The lower portion is installed below grade adjacent the roadway. The mid portion lies substantially adjacent the grade and is weakened about a first axis without being substantially weakened about a second axis that is generally perpendicular to the first axis. An upper portion is releasably coupled to the guardrail beam such that the upper portion is uncoupled from the guardrail beam when the mid portion yields about the first axis.

12 Claims, 8 Drawing Sheets

U.S. PATENT DOCUMENTS

| | | | | |
|---|---|---|---|---|
| 4,638,979 | A | 1/1987 | Demarest | 256/13.1 |
| 5,028,166 | A | 7/1991 | Leishman | 404/10 |
| 5,069,576 | A | 12/1991 | Pomero | 404/6 |
| 5,195,727 | A | 3/1993 | Liao et al. | 256/13.1 |
| 5,429,449 | A | 7/1995 | Beatz | 404/6 |
| 5,507,473 | A | 4/1996 | Hammer et al. | 256/13.1 |
| 5,957,435 | A | 9/1999 | Bronstad | 256/13.1 |
| 5,988,598 | A | 11/1999 | Sicking et al. | 256/13.1 |
| 6,007,269 | A | 12/1999 | Marinelli | 404/6 |
| 6,036,399 | A | 3/2000 | Schalk | 404/6 |
| 6,116,805 | A | 9/2000 | Gertz | 256/13.1 |
| 6,168,346 | B1 | 1/2001 | Ernsberger | 404/6 |
| 6,179,273 | B1 | 1/2001 | Edmunds et al. | 256/13.1 |
| 6,290,427 | B1 | 9/2001 | Ochoa | 404/6 |
| 6,308,936 | B1 | 10/2001 | Atwood | 256/13.1 |
| 6,409,417 | B1 * | 6/2002 | Muller et al. | 256/13.1 |
| 6,488,268 | B1 | 12/2002 | Albritton | 256/13.1 |
| 6,530,560 | B2 | 3/2003 | King | 256/1 |
| 6,533,249 | B2 | 3/2003 | Ochoa | 256/13.1 |
| 6,575,434 | B2 | 6/2003 | Bligh et al. | 256/13.1 |
| 6,644,888 | B2 | 11/2003 | Ochoa | 404/6 |
| 6,758,627 | B2 | 7/2004 | King | 404/6 |
| 6,783,116 | B2 | 8/2004 | Albritton | 256/13.1 |
| 6,793,204 | B2 | 9/2004 | Albritton | 256/13.1 |
| 6,854,716 | B2 | 2/2005 | Bronstad | 256/13.1 |
| 6,902,150 | B2 | 6/2005 | Alberson et al. | 256/13.1 |
| 7,530,548 | B2 * | 5/2009 | Ochoa | 256/13.1 |
| 2002/0021937 | A1 | 2/2002 | Ochoa | 404/6 |
| 2002/0053664 | A1 | 5/2002 | Moore | 256/13.1 |
| 2002/0081152 | A1 | 6/2002 | King | 404/6 |
| 2002/0179894 | A1 | 12/2002 | Albritton | 256/13.1 |
| 2003/0151038 | A1 | 8/2003 | Alberson et al. | 256/13.1 |
| 2004/0234334 | A1 | 11/2004 | King | 404/6 |
| 2005/0152743 | A1 | 7/2005 | Kasraie | 404/6 |
| 2006/0011900 | A1 | 1/2006 | Ochoa | 256/13.1 |
| 2007/0063177 | A1 | 3/2007 | Alberson et al. | 256/13.1 |
| 2007/0063178 | A1 | 3/2007 | Alberson et al. | 256/13.1 |
| 2007/0063179 | A1 | 3/2007 | Alberson et al. | 256/13.1 |

OTHER PUBLICATIONS

Communication relating to the results of the partial international search report, Intl. Application No. PCT/US2007/005294, Aug. 13, 2007.

PCT Notification of Transmittal of The International Search Report and the Written opinion of the International Searching Authority, or the Declaration, International Application No. PCT/US2007/005294, 16 pages, Nov. 20, 2007.

Ross et al., "NCHRP Report 350," National Cooperative Highway Research Program, 74 pages, 1993.

Federal Highway Administration, "Action: Identifying Acceptable Highway Safety Features," Memorandum, 24 pages, Jul. 25, 1997.

Buth et al., NCHRP Report 350 TL-3 Testing of the T-31 W-Beam Guardrail, Texas Transportation Institute, 78 pages, Sep. 2005.

Australian Government, IP Australia, Examiner's First Report on Patent Application No. 2007224254, 2 pages, Jul. 27, 2011.

Australian Government, IP Australia, Patent Examination Report No. 2, Patent Application No. 2007224254; 4 pages, Nov. 7, 2012.

Mexico Office Action forwarded to Baker Botts by foreign associate, Goodrich Riquelme Asociados, 3 pages, Nov. 30, 2012.

* cited by examiner

YIELDING POST GUARDRAIL SAFETY SYSTEM INCORPORATING THRIE BEAM GUARDRAIL ELEMENTS

RELATED APPLICATION

This patent application claims priority from Patent Application Ser. No. 60/778,188, filed Mar. 1, 2006, entitled STEEL YIELDING GUARDRAIL SAFETY SYSTEM.

TECHNICAL FIELD

The present invention relates generally to guardrail systems and more particularly to a yielding post guardrail safety system incorporating thrie beam guardrail elements.

BACKGROUND

Guardrail systems are widely used along heavily traveled roadways to enhance the safety of the roadway and adjacent roadside. Guardrail beams and their corresponding support posts are employed to accomplish multiple tasks. Upon vehicle impact, a guardrail acts to contain and redirect the errant vehicle.

For many years, standard heavy gauge metal guardrails known as "W-beams" have been used on the nation's roadways to accomplish these tasks and others. Named after its characteristic shape, the "W-beam" is a corrugated guardrail member that has two corrugations. The guardrail is typically anchored to the ground using support posts made of metal, wood, or a combination of both. A terminal support post is used at or near the terminal end of the guardrail system. Support posts other than the terminal support posts are termed "length-of-need" (LON) posts. LON posts support the guardrail along the intermediary portion of the guardrail system between opposing terminal ends of the guardrail system.

Wood support posts may be more readily available and more economical than metal posts in some geographical areas. In other areas, metal (e.g., steel) posts may be more readily available and more economical and may be preferred for their ease of installation using driving methods. As an additional benefit, wood support posts used in a LON or terminal portion of a guardrail system have been made to break away upon impact, thus producing a desired behavior during a collision by a vehicle at the impact site. However, in some environments, wood posts deteriorate more rapidly and alternate materials are sought.

Commonly used steel posts do not break away in the desired fashion and are not optimal for use in the guardrail system and especially not suitable for use in the terminal section of a guardrail system. Break away steel support posts that are modified to allow for failure during a collision have recently become available. Examples include a "hinged breakaway post" and the "energy absorbing breakaway steel guardrail post" described in U.S. Pat. No. 6,254,063. Many such prior attempts require substantial time, money, and resources during fabrication, modification, and/or installation.

SUMMARY

In accordance with a particular embodiment of the present invention, a guardrail safety system includes a guardrail beam operable to contain and redirect an errant vehicle to prevent the vehicle from leaving a roadway. At least a portion of the guardrail beam includes a thrie beam. A support post is coupled to the guardrail beam and includes a lower portion, a mid portion, and an upper portion. The lower portion is installed below grade adjacent the roadway. The mid portion lies substantially adjacent the grade and is weakened about a first axis without being substantially weakened about a second axis that is generally perpendicular to the first axis. An upper portion is releasably coupled to the guardrail beam such that the upper portion is uncoupled from the guardrail beam when the mid portion yields about the first axis.

Technical advantages of particular embodiments of the present invention include a guardrail safety system incorporating a guardrail beam having a varied height above the earth's surface along the length of the guardrail beam. Additionally, the multi-level guardrail beam may be supported by a guardrail support post having sufficient strength to redirect vehicles that collide along the length of the guardrail system at an angle to the flow of traffic. In particular, the modified support post, as used in a length-of-need portion of a guardrail system mitigates the severity of the interaction (snagging) between an impacting vehicle and the post without changing the deflection characteristics of the guardrail system. For example, the support posts configured to include a weakened section may release from the guardrail beam upon impact. As a result, the flanges of the support posts may be prevented from tearing the guardrail beam. Still another advantage may include the removal or reduction in size of an offset block in particular embodiments. Accordingly, a guardrail system of the present invention may provide benefits in terms of space and cost savings.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention and the advantages thereof, reference is now made to the following brief descriptions, taken in conjunction with the accompanying drawings and detailed description, wherein like reference numerals represent like parts, in which.

DETAILED DESCRIPTION OF EXAMPLE EMBODIMENTS

Figure 1:
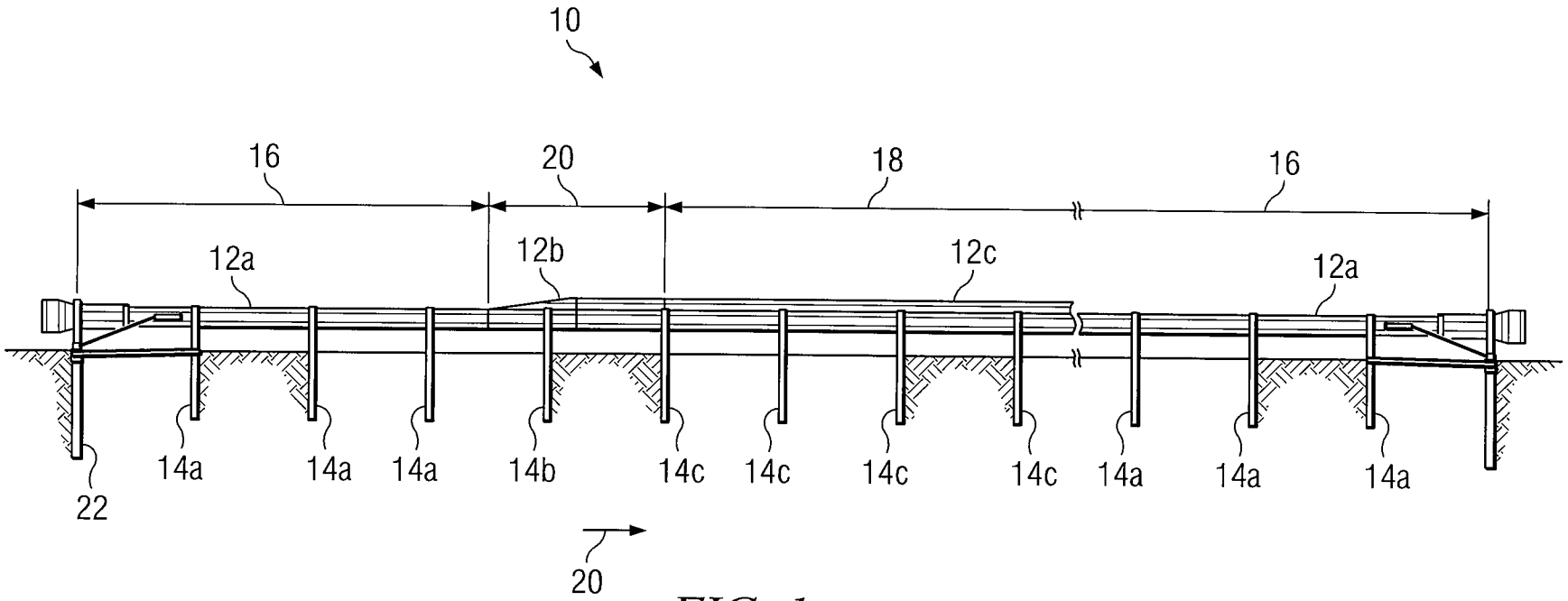
FIG. 1 illustrates a side view of a guardrail safety system that incorporates certain aspects of the present invention.

FIG. 1 illustrates a guardrail safety system 10 that incorporates certain aspects of the present invention. Guardrail system 10 may be installed adjacent a roadway to protect vehicles, drivers, and passengers from various obstacles and hazards and prevent vehicles from leaving the roadway during a traffic accident or other hazardous condition. Guardrail systems that incorporate certain aspects of the present invention may be used in median strips or shoulders of highways, roadways, or any path that is likely to encounter vehicular traffic. Guardrail system 10 includes a guardrail beam 12 and support posts 14 that anchor guardrail beam 12 in place along the roadway. As illustrated, guardrail system 10 includes five sections. Two terminal sections 16 are located on opposing ends of guardrail system 10 and are separated by an intermediary length-of-need (LON) section 18. Two transition sections 20 separate the LON section 18 from the terminal sections 16. It is generally recognized, however, that guardrail system 10 may include fewer or more sections as desired for the particular hazard or obstacle present alongside the roadway.

Support posts 14 have been modified to decrease the strength of support posts 14 in a direction generally parallel to axis 20 (generally along the direction of traffic) without substantially decreasing its strength in a direction generally perpendicular to axis 20 (out of the page in FIG. 1). Stated differently, support posts 14 exhibit adequate strength in the lateral direction but sufficiently low strength in the longitudinal direction. Accordingly, if a vehicle impacts guardrail system 10 "head-on" adjacent an end terminal support post 22, support posts 14 will tend to yield (e.g., buckle), while allowing the vehicle to decelerate as it impacts consecutive support posts 14. However, if a vehicle strikes guardrail system 10 along the face of and at an angle to guardrail beam 12, support posts 14 will provide sufficient resistance (strength) to redirect the vehicle along a path generally parallel with guardrail beam 12.

Guardrail system 10 is intended to keep errant vehicles from leaving the roadway during a crash or other hazardous situation. In many instances, guardrail 10 is installed between a roadway and a significant hazard to vehicles (e.g., another roadway, a bridge, cliff, etc.). Therefore, guardrail system 10 should be designed to withstand a significant impact from a direction that forms an angle to the roadway without substantial failure. It is this lateral strength that allows guardrail system 10 to withstand the impact and still redirect the vehicle so that it is once again traveling generally in the direction of the roadway.

Testing and experience have continuously shown, however, that guardrail systems may actually introduce additional hazards to the roadway and surrounding areas. This is particularly true with respect to vehicles that impact the guardrail system adjacent its terminal section 16 in a direction generally parallel to the roadway. For example, if the guardrail system were rigidly fixed in place during a crash, serious injury and damage may result to the errant vehicle, its driver, and passengers. Accordingly, many attempts have been made to minimize this added risk. Such methods generally include the use of terminal portions that are tapered from the ground up to effectively reduce the impact of head on collisions and to create a ramp-like effect that causes vehicles to go airborne during a crash. Other methods include breakaway cable terminals (BCT), vehicle attenuating terminals (VAT), SENTRE end treatments, extruder terminals (ET), slotted-rail terminals (SRT), and the breakaway support posts of U.S. Pat. No. 6,398,192 ("'192 patent"). Many such terminals, supports, end treatments and the like are commercially available from various organizations. Examples include the HBA post by Exodyne Technologies and Trinity Industries and a breakaway support post similar in configuration to that described in the '192 patent.

Improperly designed posts in the LON portion of a guardrail system may also introduce additional hazards to the roadway and surrounding areas. This is particularly true with respect to vehicles that impact the LON portion of the guardrail system at a substantial angle to the guardrail beam. In such a scenario, snagging or contact between the vehicle and posts can cause severe vehicle damage, deformation to the occupant compartment, high vehicle decelerations, and failure or rupture of the guardrail beam. Additionally, the guardrail may fail in its purposes of containing and redirecting the errant vehicle.

Referring again to FIG. 1, each terminal section 16 includes a terminal portion 12*a* of guardrail beam 12, one terminal end post 22, and three terminal support posts 14*a*. Transition section 20 includes a transition portion 12*b* of guardrail beam 12 and one transition end post 14*b*. LON guardrail support posts 14*c* may be used for the balance of guardrail system 10 to support a LON portion 12*c* of guardrail beam 12. As will be described in more detail below, it should be recognized that terminal support posts 14*a*, transition support post 14*b*, and LON support posts 14*c* may be identical or may differ where desired. In particular embodiments, for example, terminal support posts 14*a*, transition support posts 14*b*, and LON support posts 14*c* may differ in size and configuration where the terminal sections 16, transition sections 20, and LON section 18 are designed for different impact conditions. In other embodiments, terminal support posts 14*a*, transition support posts 14*b*, and LON support posts 14*c* may be identical or substantially identical such that any support post 14 described herein is suitable for installation at any location within guardrail system 10. In such embodiments, terminal support posts 14*a*, transition support posts 14*b*, and LON support posts 14*c* may be interchangeable within guardrail system 10.

Whether located in the terminal, transition, or LON portions of the system, support posts 14 may be embedded in the ground, a concrete footing, or a metal socket. Support posts 14 may be made of wood, metal, plastic, composite materials, or any combination of these or other suitable materials. It is also recognized that each support post 14 within guardrail system 10 need not necessarily be made of the same material or include the same structural features. Furthermore, the cross-section of support posts 14 may be any engineered shape suitable for releasably supporting guardrail beam 12. Such cross-sectional shapes may include, but are not limited to, square, rectangular, round, elliptical, trapezoidal, solid, hollow, closed, or open.

Although FIG. 1 is illustrated without dimensions, in a particular embodiment, it is understood that guardrail system 10 may be of different lengths depending on the nature of the roadside hazard being shielded. For example, each terminal section 16 may have a length on the order of approximately 11.4 or 15.2 meters (37.5 or 50 feet). Each transition section 20 may have a length on the order of approximately 1.9 or 3.8 meters (6.25 or 12.5 feet), in a particular embodiment. LON section 18 will have a length that varies as needed. In such an embodiment, support posts 14 may be placed along guardrail beam 12 at a spacing on the order of approximately 1.9 meters (6.25 feet) or other distance as required to obtain the desired deflection and impact performance.

In the illustrated embodiment, guardrail system 10 includes components that may vary slightly depending upon whether the components are located in a terminal section 16, a transition section 20, or a LON section 18. For example, terminal section 16 of guardrail system 10 includes a terminal guardrail portion 12*a* supported on terminal support posts 14*a*. In the illustrated embodiment, terminal guardrail portion 12*a* includes a corrugated member comprised of multiple 3.8-m (12.5-ft) long 12-gauge rail elements. The corrugated guardrail beam sections typically have two corrugations and may be mounted with rail splices positioned mid-span between the support posts. The height to the top edge of terminal guardrail portion 12*a* is approximately 784 millimeters (31 inches). It is generally recognized, however, that the illustrated and described terminal guardrail portion 12*a* is merely one example of a beam that may be used in a guardrail system. Guardrail portion 12*a* may include conventional "W"-shaped guardrails, wire ropes, or other structural members and may be of any desired dimensions suitable for redirecting an errant vehicle upon impact.

The non-terminal end of terminal guardrail portion 12*a* is spliced to a transition guardrail portion 12*b* supported on a transition support post 14*b*. In the illustrated embodiment, transition guardrail portion 12*b* begins as a "W-shaped" guardrail beam with dimensions similar to those described above with respect to terminal guardrail portion 12*a*. Transition guardrail portion 12*b* then gradually transitions into a thrie guardrail beam. Stated differently, transition guardrail portion 12*b* includes two corrugations at a terminal end and three corrugations at a LON end. The upper elevation of the transition guardrail portion 12*b* is sloped to accommodate the transition from two corrugations to three corrugations. As illustrated, the height to the top edge of transition guardrail portion 12*b* at the terminal end is approximately 784 millimeters (31 inches) above the ground's surface. Conversely, the height to the top edge of transition guardrail portion 12*b* at the LON end is approximately 991 millimeters (39 inches) above the ground's surface.

Figure 2C:
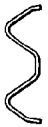
FIGS. 2A-2C illustrate a transition portion of a guardrail beam suitable for use with the guardrail system of FIG. 1, in accordance with a particular embodiment of the present invention.
Figure 2B:
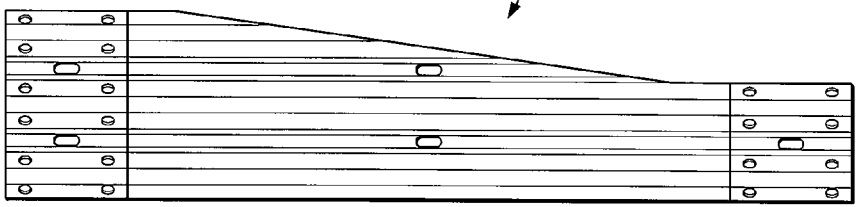
Figure 2A:
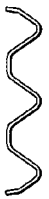

In a particular embodiment, transition guardrail portion 12*b* includes a single 1.9 meters (6.25 feet) or 3.8 meters (12.5 feet) long rail element. The opposing ends of transition guardrail portion 12*b* may be mounted to terminal guardrail portion 12*a* and a LON guardrail portion 12*c*, respectively. A support post 14*b* may be positioned mid-span along transition guardrail portion 12*b*. An example transition guardrail portion 12*b* is illustrated in more detail in FIGS. 2A-2C.

Figure 3B:
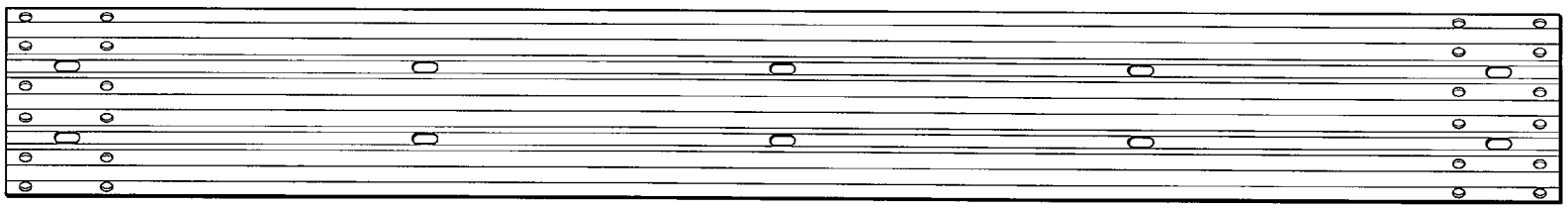
FIGS. 3A and 3B illustrate a length-of-need portion of a guardrail beam suitable for use with the guardrail system of FIG. 1, in accordance with a particular embodiment of the present invention.
Figure 3A:
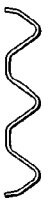

In the illustrated embodiment, LON guardrail portion 12*c* includes a thrie-beam comprised of multiple thrie-beam rail elements each on the order of 3.8 meters (12.5 feet) long. The thrie-beam guardrail beam sections may be mounted such that the top of the LON guardrail portion 12*c* is approximately 991 millimeters (39 inches) above the ground's surface. Splices connecting adjacent rail elements may be positioned mid-span between the LON support posts 14*c*. An example LON guardrail portion 12*c* is illustrated in more detail in FIGS. 3A and 3B. It is generally recognized, however, that the illustrated thrie-beam guardrail beams are merely examples of beams that may be used in a guardrail system. Other guard rail beams may include conventional W-shaped corrugated guardrails, wire ropes, or other structural members suitable for redirecting an errant vehicle upon impact.

Figure 4A:
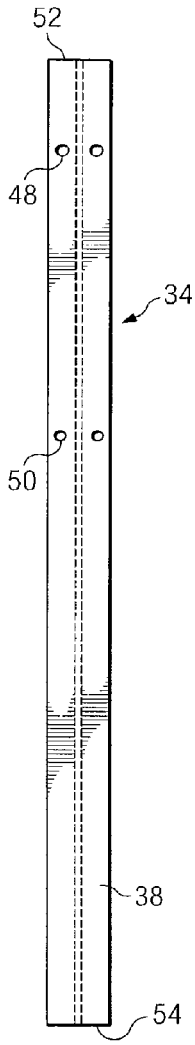
FIGS. 4A-4C illustrate a guardrail support post suitable for use with the guardrail system of FIG. 1, in accordance with a particular embodiment of the present invention.
Figure 4B:
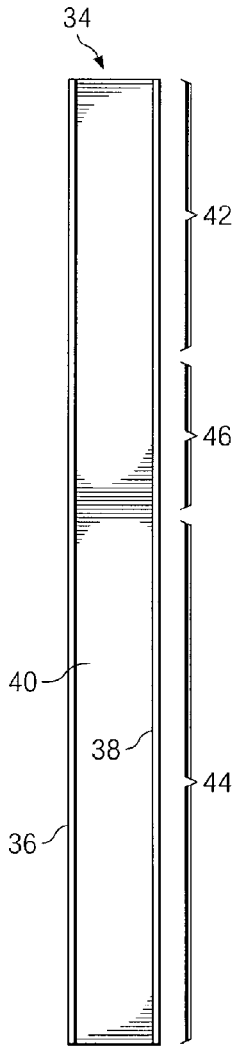
Figure 4C:
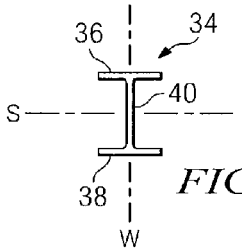

FIGS. 4A-4C illustrate a guardrail support post 34, in accordance with a particular embodiment of the present invention. Support post 34 includes an elongate continuous structural member of a standard Wide flange configuration. Support post 34 includes two flanges 36 and 38 that are generally parallel with one another and in a spaced relation. A web 40 forms the coupling between flanges 36 and 38. Flanges 36 and 38 include a generally identical configuration of boltholes 48 and cutouts 50, therein.

With regard to a Wide flange shape used as a guardrail post, the cross section is typically shaped like the letter "H" or "I". The cross section has two major axes for bending. The "weak" axis generally refers to a central axis that extends through the web and is perpendicular to the flanges. The "strong" axis generally refers to a central axis that is perpendicular to the web and parallel to the planes of the flanges. The weak axis for a conventional installation of guardrail extends generally transversely to the road. The strong axis extends generally along the roadway.

In the illustrated embodiment of FIGS. 4A-4C, the Wide flange is a standard W6×8.5, which is commonly used in fabricating support posts for guardrail installations. One advantage of some embodiments is the ability to re-use existing standard equipment to fabricate, modify, and install support post 34 without substantial modification to the equipment. Those of ordinary skill in the art will recognize that wide flange beams may be available in many different sizes. For example, a standard W6×8.5 Wide flange may have a nominal six-inch depth and weigh eight and one-half pounds per foot. However, a Wide flange having a six-inch depth and weighing nine pounds per foot, referred to as a W6×9 Wide flange, is considered equivalent in the trade. In addition, persons skilled in the art recognize other names used for wide flanges include but are not limited to "I-beam," "H-beam," "W-beam," "S-beam," "M-beam," or the term "shape" may be substituted for "beam."

Support post 34 includes a relatively "weak" axis W and a relatively "strong" axis S. For the reasons described above, support post 34 is normally installed along a roadway such that weak axis W is generally perpendicular to the direction of traffic, and strong axis S is generally parallel to the direction of traffic. Accordingly, support post 34 is typically able to withstand a significant impact (e.g., with a car traveling at a high rate of speed) about the strong axis S without substantial failure. However, support post 34 is intentionally designed such that yielding will more readily occur in response to an impact about the weak axis W.

In particular embodiments, the W6×8.5 such as that illustrated in FIGS. 4A-4C may be particularly well suited for installation as a support post 14*a* in terminal section 16 of guardrail system 10. In other embodiments, support post 34 may comprise a transition support post that is configured to support a transition portion of a guardrail beam 12*b*. In still other embodiments, support post 34 may comprise a LON support post that is configured to support a LON portion of guardrail beam, such as LON guardrail portion 12*c*.

In the illustrated embodiment, support post 34 has a length on the order of approximately 1,830 millimeters (6 feet) and includes an upper portion 42, a lower portion 44, and a mid portion 46. The overall length of support post 34 and its upper, lower, and mid portions may vary significantly within the teachings of the present invention. Lower portion 44 is suitable for installation below grade as part of a guardrail support system. Upper portion 42 includes two boltholes 48 in each of flanges 36 and 38 that are adapted to receive connectors for the installation of a guardrail beam (e.g., guardrail beam 12) upon support post 34.

Bolt holes 48 include a standard configuration that allow for the installation of widely used guardrail beams upon support posts 34. In general, bolt holes 48 maintain the center of the guardrail beam at a distance that is between 550 and 750 millimeters (1.8-2.5 feet) above grade. In the particular embodiment illustrated, bolt holes 48 maintain the center of the guardrail beam at a distance that is on the order of 550 (1.8 feet) above grade. Bolt holes 48 have a diameter on the order of approximately 21 millimeters. However, it is generally recognized that the illustrated dimensions are for example purposes only; the number, size, location and configuration of boltholes 48 may be significantly modified within the teachings of the present invention.

Mid portion 46 includes two cutouts 50 in both flanges 36 and 38, which are configured to weaken support post 34 about the weak axis W, to more readily allow for yielding due to impact from a vehicle along that direction. Cutouts 50 provide reduced strength in the longitudinal direction without substantially changing the strength of the support post in the lateral direction. Cutouts 50 are positioned within mid portion 46 to weaken support post 34 about weak axis W adjacent grade (when installed). This will accommodate yielding of support post 34 approximately at grade, allowing support post 34 to "fold" over from the point of yielding, upward. Since lower portion 44 is below grade, it is not expected that the ground or lower portion 44 of support post 34 will appreciably deflect during an impact about the weak axis of the post. In the illustrated embodiment of FIGS. 4A-4C, cutouts 50 are approximately 13 millimeters in diameter. It is generally recognized, however, that the provided dimensions of cutouts 72 are provided for example purposes only. Although the diameter of cutouts 72 may vary, in particular embodiments, between approximately 13 and 21 millimeters, it is recognized that cutouts 72 and bolt holes 74 may be of any appropriate size. Additionally, it is not necessary that cutouts 72 in a support post be of the same dimension. Thus, a single support post may include cutouts of varying dimensions for a desired weakening of the support post.

Since cutouts 50 are intended to occur approximately at grade and the center of bolt holes 48 are intended to occur between 550 and 750 millimeters (1.8-2.5 feet) above grade, bolt holes 48 occur between 550 and 750 millimeters (1.8-2.5 feet) above cutouts 50. In the illustrated embodiment, bolt holes 48 occur at approximately 550 millimeters (1.8 feet) above cutouts 50. It will be recognized by those of ordinary skill in the art, however, that the size, configuration, location and number of bolt holes, cutouts, and their relationship with each other may be varied significantly within the teachings of the present invention.

Additionally, the location of cutouts 50 may vary in accordance with the teachings of the present invention. The configuration of FIGS. 4A-4C envisions that cutouts 50 will occur approximately at grade level. In other embodiments, cutouts 50 may occur below grade or above grade. The depth of cutouts 50 below grade should not exceed an amount that will prevent support post 34 from yielding at or near the location of cutouts 50. At some depth below grade, the surrounding earthen (or other) material will reinforce lower portion 44 of support post 34 to an extent that will no longer accommodate such yielding to occur.

The height of cutouts 50 above grade should not exceed a point at which support post 34 will yield at cutouts 50 and leave a "stub" above grade that can snag vehicles and otherwise cause excessive injury and/or excessive damage. Such a stub could be detrimental to the redirective effect of the guardrail system in which support post 34 is operating.

Support post 34 is a single, continuous structural member that does not require any labor in field assembly, welding, or special handling. With the exception of boltholes 48 and cutouts 50, support post 34 has a continuous, generally uniform cross-section from top edge 52 to bottom edge 54. Therefore, fabrication of support post 34 is simplified with respect to other multiple component products. Furthermore, support post 34 can be shipped as one piece and installed as one piece. Many prior attempts that included multiple components that were hinged or otherwise connected could not be shipped and/or installed as a single unit without damaging the support post.

Similarly, many such prior efforts required specialized equipment for proper installation and often required a significant amount of field labor to perform such installation. In contrast, support post 34 can be installed using traditional guardrail post installation equipment (e.g., guardrail post drivers).

Previous attempts to accommodate failure of a guardrail support post have often weakened the support post about the strong axis S, which impacts the support post's ability to redirect a vehicle that collides with the support in a direction generally perpendicular to or at an angle to the roadway. For this reason, such support posts may be unacceptable for use along a roadway and may fail to comply with governing federal standards bodies' requirements. Patent Application PCT/US98/09029 ('029 application) illustrates a support post having slotted openings disposed therein. These slots are substantially longer (vertically) than they are wide (horizontal).

Cutouts 50 of support posts 34 are configured to reduce the strength of support post 34 about weak axis W, without substantially changing the behavior of the support post 34 about strong axis S. In the illustrated embodiment, cutouts 50 comprise generally circular openings that have been punched or drilled through support post 34. Cutouts 50 provide an enhanced ability to control the point of yielding of support post 34 during a collision with a vehicle. For example, the support post of the '029 application may fail at any point along the slots, and failure may be based upon imperfections in the material adjacent the slots. By limiting the vertical dimension of cutout 50, it is easier to dictate the precise point of failure of support post 34 along its vertical length.

Furthermore, the slots of the '029 application require the removal of a substantial amount of material from the flange. This weakens the flange along directions other than perpendicular to the web. Furthermore, during a dynamic crash situation in which the impact may come from any angle, twisting or bending of the flange may result in the flange changing its orientation in response to the initial impact. Accordingly, the support post having vertical slots similar to the '029 application may fail prematurely along the strong axis and lose its ability to redirect the vehicle.

In accordance with certain example embodiments of the present invention, the vertical dimension of cutout 50 is limited based upon the horizontal dimension of cutout 50. For example, a ratio of the vertical dimension of any particular cutout may be equal to or less than three times the horizontal dimension. Alternatively, the ratio may be limited to two times the horizontal dimension. In the illustrated embodiment of FIGS. 4A-4C, the ratio is 1:1 since cutout 50 is generally a circular opening in the support post. The smaller the vertical dimension of the cutout, the more precisely the designer may dictate the point of yielding along the vertical length of support post 34.

Various configurations of cutouts 50 are available to a designer of support post 34, in accordance with the teachings of the present invention. The geometry and size of the opening is as is required for a given post cross section. For example, rather than circular openings, cutouts 50 may comprise elliptical, square, rectangular, triangular, oval, semi-circular, diamond shaped, or practically any other geometric configuration and still obtain some or all of the benefits described herein. Cutouts 50 are positioned, shaped, and sized such that support post 34 retains sufficiently high strength in the lateral direction (the direction perpendicular to the guardrail beam 12) to capture and redirect an impacting vehicle with reasonable dynamic deflection.

The horizontal location of cutouts 50 within flanges 36 and 38 may also be altered significantly, within the teachings of the present invention. The opening or other weakened section may be located on the interior of the post or may intersect an exterior edge. In the illustrated embodiment of FIGS. 4A-4C, cutouts 50 are located approximately 20 millimeters (0.79 inches) from outer edges of flanges 36 and 38. However, in alternative embodiments, cutouts 50 may be located closer to such edges or further from such edges. In one embodiment, cutouts 50 may be configured such that they extend all the way to the edge of the flange such that there is a break in material beginning at the edge. In this manner, a traditional punch could be employed at the edge to form a semi-circular opening that extends to the edge of the flange.

Alternatively, a sawcut, diamond shaped notch, or other notch or cut could be employed from the outer edge of the flange and extended inward to form cutouts 50. In this manner, the sawcut, diamond shaped notch, or other notch or cut would form the starting point of the likely point of yielding along the weak axis of the support post. Rather than a sawcut, a similar configuration may include a slot in which the longest dimension extends horizontally through the flange. Such a slot may begin or terminate at the edge of the flange or otherwise be disposed completely within the material of the flange. Where the weakened section includes one or more notches, the notches may be cut into the side of the post in one embodiment. Where the weakened section includes a slot, the slot may include a sharp or round-edged bottom.

Figure 5A:
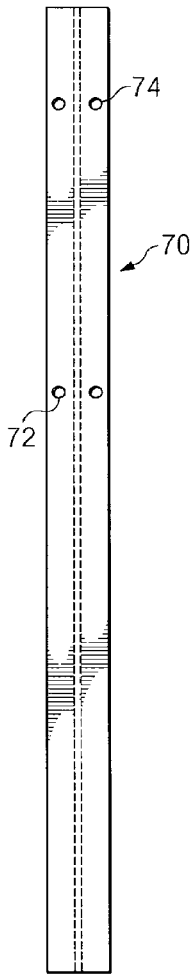
FIGS. 5A-5C illustrate another guardrail support post suitable for use with the guardrail system of FIG. 1, in accordance with another embodiment of the present invention.
Figure 5B:
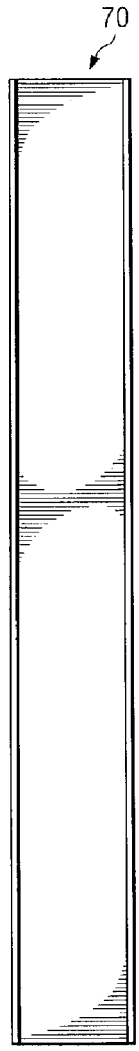
Figure 5C:
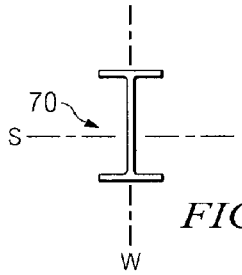

FIGS. 5A-5C illustrate a support post 70, in accordance with another embodiment of the present invention. Support post 70 is a W8×10 Wide flange and is therefore slightly larger and heavier than the W6×8.5 Wide flange of FIGS. 4A-4C. In particular embodiments, the W8×10, such as that illustrated in FIGS. 5A-5C, may be particularly well suited for installation as a support post 34 in terminal portion 16 of guardrail system 10. Additionally or alternatively, support post 70 may be used when additional strong axis strength is desired to, for example, reduce deflection of guardrail system 10 while sufficiently reducing the strength of the post about the weak axis to maintain vehicle contact forces and damage at acceptable levels.

Support post 70 is very similar in configuration to support post 34, although many of the dimensions of relative aspects and components are slightly different. Therefore, support post 70 will not be described in significant detail. Cutouts 72 of support post 70 are slightly larger than cutouts 50 of FIGS. 2A-2C. In the illustrated embodiment of FIGS. 4A-4C, cutouts 72 are approximately 21 millimeters in diameter. It is generally recognized, however, that the provided dimensions of cutouts 72 and bolt holes 74 are provided for example purposes only; cutouts 72 and bolt holes 74 may be of any appropriate size. Although the diameter of cutouts 72 may vary, in particular embodiments, between approximately 13 and 21 millimeters, it is recognized that cutouts 72 and bolt holes 74 may be of any appropriate size. It is not necessary that cutouts 72 in a support post be of the same dimension. Thus, a single support post may include cutouts of varying dimensions for a desired weakening of the support post. However, where cutouts 72 are the same size as bolt holes 74, fabrication of support post 70 is simplified since the same tools that are used to punch bolt holes 74 may be used to punch cutouts 72. Tooling costs are thereby reduced since the tools need only be re-indexed to provide additional holes for cutouts 72.

Figure 6A:
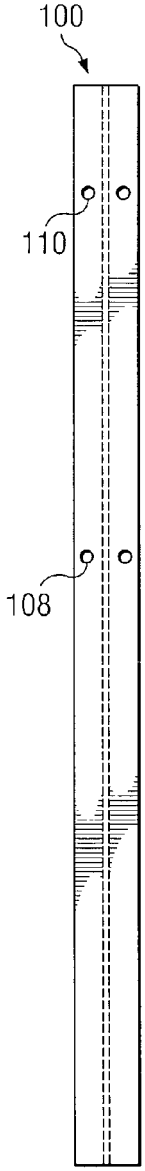
FIGS. 6A-6C illustrate another guardrail support post suitable for use with the guardrail system of FIG. 1, in accordance with a particular embodiment of the present invention.
Figure 6B:
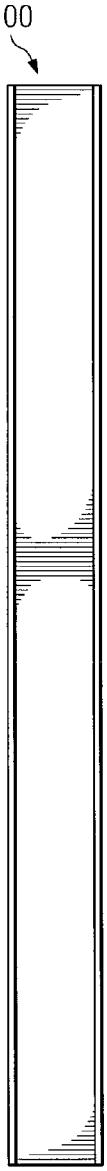
Figure 6C:
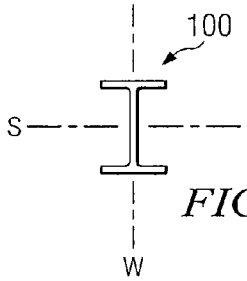

FIGS. 6A-6C illustrate a support post 100, in accordance with another embodiment of the present invention. In the illustrated embodiment, support post 100 is a W6×8.5 Wide Flange configured such that support post 100 may be particularly well suited for installation as a LON support post 14*c* in LON portion 18 of guardrail system 10. Accordingly, support post 100 may also be described herein as "LON support post 100." LON support post 100 is very similar in configuration to support post 34, although many of the dimensions of relative aspects and components are slightly different. The illustrated embodiment may provide optional weakening about the weak axis without appreciably affecting the strong axis strength of the post. It is also one of the most economical embodiments for achieving satisfactory impact performance of guardrail system 10.

As shown in FIGS. 6A-6C, LON support post 100, which supports a guardrail beam, such as guardrail beam 12, has a length of approximately 1.8 meters (6 feet). When incorporated into a guardrail system, such as guardrail system 10, multiple LON support posts 100 may be spaced approximately 1.9 meters (6.25 feet) on center, in a particular embodiment. Although bolt holes 110 are depicted as maintaining the center of the guardrail beam at a distance that is on the order of 635 millimeters (25 inches) above grade, it is generally recognized that the illustrated dimensions are for example purposes only. The number, size, location, and configuration of boltholes 48 may be significantly modified within the teachings of the present invention. In various embodiments, it is anticipated that bolt holes 110 may maintain the center of the guardrail beam at a distance that is between 550 and 750 millimeters (1.8-2.5 feet) above grade.

Similar to the support posts described above, LON support post 100 has adequate strength in the lateral direction and sufficiently low strength in the longitudinal direction. LON support post 100 may be embedded in the ground, a concrete footing, or a metal socket. LON support post 100 may be made of wood, metal, plastic, composite materials, or any combination of these or other suitable materials. Furthermore, the cross-section of LON support post 100 may be any engineered shape suitable for releasably supporting a guardrail beam, such as guardrail beam 12. Such cross-sectional shapes may include, but are not limited to, square, rectangular, round, elliptical, trapezoidal, solid, hollow, closed, or open.

Similar to previously described embodiments, LON support post 100 includes a weakened section, such as cutouts 108, that provide reduced strength in the longitudinal direction without substantially changing the strength of LON support post 100 in the lateral direction. The weakened section may include one or more openings in the form of round or elliptical holes, notches, vertical slots, horizontal slots, saw cuts, or any combination of these or other openings. Alternatively, a sawcut, diamond shaped notch, or other notch or cut could be employed from the outer edge of the flange and extended inward to form cutouts 50. As discussed above, the weakened section is generally at ground level such that LON support post 100 will yield at ground level but may vary above or below grade. The term "yield," as used herein, is defined broadly to mean yield, fracture, or fail.

The opening or other weakened section may be located on the interior of the post or may intersect an exterior edge. The geometry and size of the opening is as is required for a given post cross section such that the force required to fail, fracture, or yield the post about its strong axis is reduced such that the magnitude and severity of vehicle contact or snagging forces are reduced to safe levels that mitigate the potential for occupant injury and vehicle instability. Where the weakened section includes one or more sawcuts, diamond shaped notches, or other notches or cuts, the weakened section may be cut into the side of the post in one embodiment. Where the weakened section includes a slot, the slot may include a sharp or rounded edge bottom.

As shown in FIG. 6A, the weakened section includes cutouts 108 of support post 100, which are approximately 21 millimeters (13/16 of an inch) in the illustrated embodiment. Like support post 70, cutouts 108 are the same size as bolt-holes 110 in this configuration. Accordingly, fabrication of LON support post 100 is simplified since the same tools that are used to punch bolt holes 110 may be used to punch cutouts 108. Tooling costs are thereby reduced since the tools need only be re-indexed to provide additional holes for cutouts 108. It is generally recognized, however, that the provided dimensions of cutouts 72 and bolt holes 74 are provided for example purposes only. Although the diameter of cutouts 72 may vary, in particular embodiments, between approximately 13 and 21 millimeters, it is recognized that cutouts 72 and bolt holes 74 may be of any appropriate size. Additionally, it is not necessary that cutouts 72 in a support post be of the same dimension. Thus, a single support post may include cutouts of varying dimensions for a desired weakening of the support post.

Figure 7A:
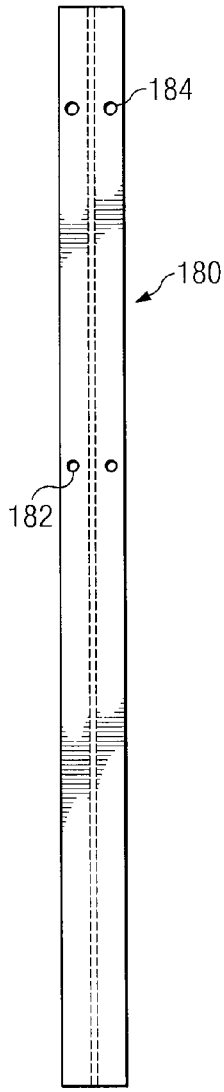
FIGS. 7A-7C illustrate another guardrail support post suitable for use with the guardrail system of FIG. 1, in accordance with another embodiment of the present invention.
Figure 7B:
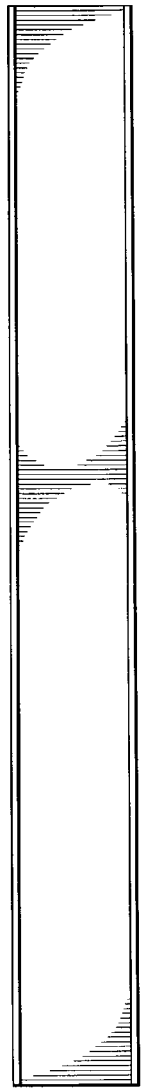
Figure 7C:
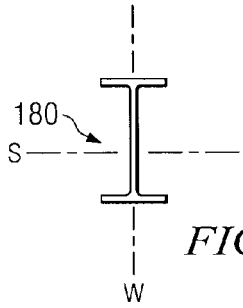

FIGS. 7A-7C illustrates a LON support post 180, in accordance with an alternative embodiment of the present invention. LON support post 180 is a W8×10 Wide flange and is, therefore, larger and heavier than the W6×8.5 Wide flange of FIGS. 6A-6C. LON support post 180 is very similar in configuration to previously described support posts, although many of the dimensions of relative aspects and components may be slightly different. For example, cutouts 182 of LON support post 180 are approximately 13 millimeters (0.5 inches) in diameter. In this configuration, cutouts 182 are slightly smaller than bolt holes 184, which are approximately 21 millimeters (0.82 inches) in diameter. It is generally recognized, however, that the provided dimensions of cutouts 182 and bolt holes 184 are provided for example purposes only. Cutouts 182 and bolt holes 184 may be of any appropriate size. Like the embodiments described above, although the diameter of cutouts 72 may vary, in particular embodiments, between approximately 13 and 21 millimeters, it is recognized that cutouts 72 and bolt holes 74 may be of any appropriate size. Additionally, it is not necessary that cutouts 72 in a support post be of the same dimension. Thus, a single support post may include cutouts of varying dimensions for a desired weakening of the support post.

Figure 8A:
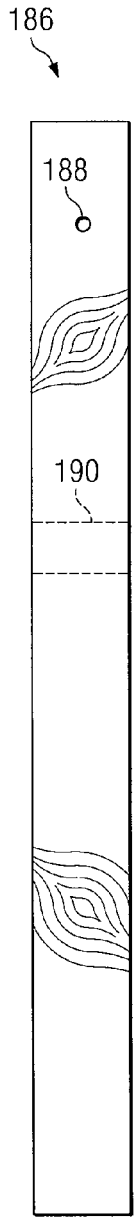
FIGS. 8A-8C illustrate another guardrail support post suitable for use with the guardrail system of FIG. 1, in accordance with another embodiment of the present invention.
Figure 8B:
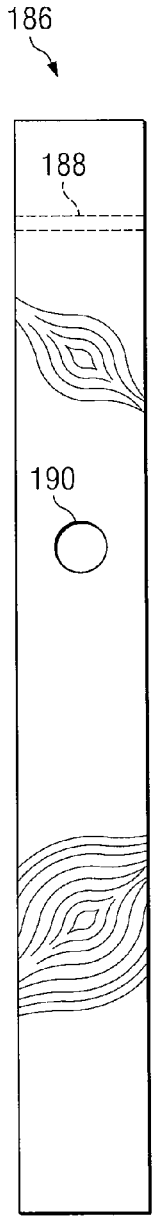
Figure 8C:
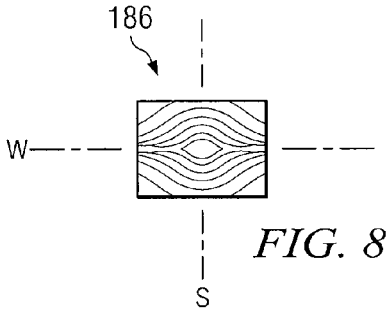

FIGS. 8A-8C illustrate a LON support post 186, in accordance with an alternative embodiment of the present invention. As illustrated, LON support post 186 is a 6×8 wood post. Thus, LON support post 186 has a nominal width of approximately 6 inches and a nominal depth of approximately 8 inches. Although formed of wood, it is anticipated that support post 186 may be particularly well suited for installation as a LON support post 14*c* in LON portion 18 of guardrail system 10. The illustrated embodiment may provide optional weakening about the weak axis without appreciably affecting the strong axis strength of the post.

As shown in FIGS. 8A and 8B, LON support post 186, which supports a guardrail beam, such as guardrail beam 12, has a length of approximately 1830 millimeters (6 ft). Bolt holes 188 have a diameter on the order of approximately 21 millimeters (13/16 of an inch). Although bolt holes 188 are depicted as maintaining the center of the guardrail beam at a distance that is on the order of 550 millimeters (21.65 inches) above grade, it is generally recognized that the illustrated dimensions are for example purposes only; the number, size, location, and configuration of bolt holes 188 may be significantly modified within the teachings of the present invention. In various embodiments, it is anticipated that bolt holes 188 may maintain the center of the guardrail beam at a distance that is between 550 and 750 millimeters (21.65 and 30 inches) above grade.

LON support post 186 is formed of wood, plastic, or a composite material and may be embedded in the ground, a concrete footing, a metal socket, or a foundation tube. Although illustrated as having a 6×8 rectangular shape, the cross-section of LON support post 186 may be any engineered shape suitable for releasably supporting a guardrail beam, such as guardrail beam 12. Such cross-sectional shapes may include, but are not limited to, square, rectangular, round, elliptical, trapezoidal, solid, hollow, closed, or open.

Similar to the support posts described above, LON support post 186 has adequate strength in the lateral direction and sufficiently low strength in the longitudinal direction. Specifically, LON support post 186 includes a weakened section, such as a cutout 190, that provides reduced strength in the longitudinal direction without substantially changing the strength of LON support post 186 in the lateral direction. As shown in FIGS. 8A-8C, cutout 190 of support post 186 is of a circular shape and has a diameter on the order of approximately 89 millimeters (3.5 inches). It is generally recognized, however, that the provided dimensions of cutout 190 is provided for example purposes only. Further, the weakened section may include one or more openings in the form of round or elliptical holes, semi-circular openings, diamond notches, notches, vertical slots, horizontal slots, saw cuts, or any combination of these or other openings.

As discussed above, the weakened section is generally at ground level such that LON support post 186 will fail, fracture, or yield at ground level, but may vary above or below grade. The opening or other weakened section may be located on the interior of the post or may intersect an exterior edge. The geometry and size of the opening is as is required for a given post cross section such that the force required to fail, fracture, or yield the post about its strong axis is reduced such that the magnitude and severity of vehicle contact or snagging forces are reduced to safe levels that mitigate the potential for occupant injury and vehicle instability. Where the weakened section includes one or more notches, the notches may be cut into the side of the post in one embodiment. Where the weakened section includes a slot, the slot may include a sharp or rounded edge bottom.

In operation, the LON support posts described above in FIGS. 4A-4C, 5A-5C, 6A-6C, 7A-7C, and 8A-8C are connected to the guardrail beam such that upon impact, the connection between the LON support posts and guardrail beam will yield in preferred embodiments. Because the LON support posts include weakening cutouts at approximately the ground elevation, the LON support posts may bend at the weakened section upon vehicular impact. Despite the deflection of LON support posts upon impact, however, the guardrail beam may remain at the originally designed elevation. As a result, the guardrail beam may substantially prevent an errant vehicle from running over the guardrail beam and/or becoming unstable.

In the illustrated embodiments of FIGS. 4A-4C, 5A-5C, 6A-6C, 7A-7C, and 8A-8C, the support posts have a length of approximately 1830 millimeters (72 inches). The cutouts, which are configured to be positioned proximate ground level, are approximately, 1016-1118 millimeters (40 to 44 inches) from the underground end of the support post. The remaining 711 to 812 millimeters (28 to 32 inches) of the support post extends above-ground.

In particular embodiments, where the support post comprises a LON support post (such as support post 14*c*) configured to support a thrie beam element (such as guardrail portion 12*c*), the support post may be shorter than the top elevation of the thrie beam element. Where the top elevation of the thrie beam element of LON guardrail portion 12*c*, for example, is approximately 991 millimeters (39 inches) above the ground's surface, approximately 152 to 177 millimeters (6 to 7 inches) of LON guardrail portion 12*c* extends above the LON support post. In such embodiments, the top portion of the thrie beam element is unsupported by the LON support post. A LON support post of such a configuration may be substantially cheaper than a LON support post of a length sufficient to extend 991 millimeters (39 inches) above the ground's surface (a distance that may correspond with the top elevation of the LON guardrail portion 12*c*, in some embodiments). In a particular embodiment, a single connector may couple the guardrail beam portion 12*c* to support post 14*c* through a lower bolt hole of guardrail beam (shown in FIG. 2B).

In still other embodiments, the LON support post may be of a length that is sufficient to support the thrie beam element in its entirety. For example, the LON support post may be of a length that results in the top of the support post corresponding generally with the elevation of the top of the thrie beam element. Where the top elevation of the thrie beam element is approximately 991 millimeters (39 inches) above the ground's surface, for example, the length of the support post may be approximately 177 millimeters (7 inches) longer than the illustrated LON support post.

As another example, the LON support post may extend above the top elevation of the guardrail beam element. For example, in a particular embodiment, the LON support post may have a length of approximately 2032 millimeters (80 inches). Where approximately 1016 millimeters (40 inches) of the support post extends below the ground's surface, such a support post may extend approximately 25 millimeters (1 inch) above the top elevation of a thrie beam element having a top elevation of approximately 991 millimeters (39 inches) above the ground's surface. Thus, it is generally recognized, that a taller support post may be desired in some embodiments.

Many advantages may be realized by the use of modified, engineered LON support posts of FIGS. 4A-4C, 5A-5C, 6A-6C, 7A-7B, and 8A-8C. First, use of modified, engineered posts in the standard LON or non-terminal portion of the guardrail system mitigates the severity of the interaction (snagging) between an impacting vehicle and the post without changing the deflection characteristics of the guardrail system. Second, because the LON support posts release from the guardrail beam, the flanges of the LON support posts may be prevented from tearing the guardrail beam. As a result, offset blocks (spacers placed between the flanges of the LON support post and the guardrail beam) may be reduced in size or removed altogether, which can provide benefits in terms of space and cost savings.

Figure 9:
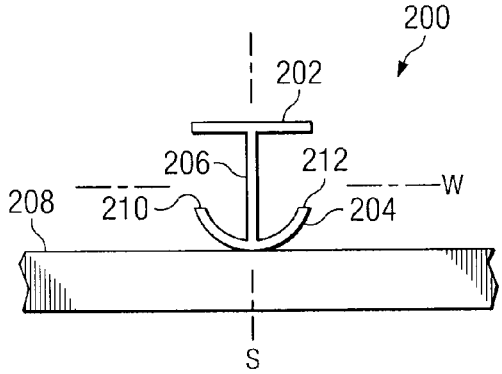
FIG. 9 illustrates a guardrail support post that includes a modified flange for the protection of a guardrail beam, in accordance with one embodiment of the present invention.

Other modifications to support posts and LON support posts in particular, may further prevent tearing of the guardrail beam upon impact. For example, FIG. 9 illustrates a support post 200 that includes a modified flange for the further protection of the guardrail beam. It is generally recognized that support post 200 may include a terminal support post 14*a* or a LON support post 14*c*. In the illustrated embodiment, support post 200 includes an elongate, continuous structural member of a modified Wide flange configuration. Similar to the support posts described above, support post 200 includes two flanges 202 and 204 that are coupled at their respective midpoints by a web 206. Flanges 202 and 204 at their respective midpoints are generally parallel with one another and in a spaced relation.

With regard to the modified Wide flange shape used as support post 200, the cross section of support post 200 is shaped like a modified letter "H" or a modified letter "I". Specifically, a first flange 202 is substantially straight and, thus, forms a standard leg of an "H" or "I". A second flange 204 includes a substantially rounded surface such that a first edge 210 and a second end 212 of second flange 204 is curved inward toward web 206 and first flange 202. Second flange 204 forms the face of the support post 200 that couples to and lies adjacent to a guardrail beam 208.

In particular embodiments, second flange 204 may be slightly longer than first flange 202. For example, in a particular embodiment, support post 200 is formed from a modified W6×8.5. Whereas a standard W6×8.5 member may include two flanges that are each approximately four inches long, second flange 204 is slightly longer than the standard flange and, thus, slightly longer than first flange 202. For example, in a particular embodiment, second flange 204 may have a length that is approximately six inches long.

Although second flange 204 is shown as being rounded along the length of support post 200, it is possible that only a top portion of the support post 200 includes a modified second flange 204. Thus, in a particular embodiment, only the top 355 to 406 millimeters (14 to 16 inches) of flange 204 as measured from the top of support post 200 when it is mounted in the ground may be curved. The remaining portion of second flange 204 may be as described above with regard to alternative embodiments of support posts.

In operation, because second flange 204 is rounded toward first flange 202, no sharp edges of support post 200 are adjacent to guardrail beam 208. As a result, guardrail beam 208 is not susceptible to rupture by the sharp edges of support post 200 when an errant vehicle comes into contact with the support post-guardrail beam combination.

Despite some structural and orientation differences discussed above, flanges 202 and 204 of support post 200 may include, in particular embodiments, a weakened section such that, similar to the support posts discussed above, modified support post 200 includes a relatively "weak" axis W and a relatively "strong" axis S. For the reasons described above, modified support post 200 is normally installed along a roadway such that weak axis W is generally perpendicular to the direction of traffic, and strong axis S is generally parallel to the direction of traffic. Accordingly, modified support post 200 is typically able to withstand a significant impact (e.g., with a car traveling at a high rate of speed) about the strong axis S without substantial failure. However, modified support post 200 is intentionally designed such that yielding will more readily occur in response to an impact about the weak axis W.

The modification of the support post to include a curved flange as shown in FIG. 9 is merely one method of protecting a guardrail beam from potential tearing by the support post. Previous methods for preventing the rupturing of the guardrail beam by the sharp edges of the support post flanges include the positioning an offset block between the flange of support post 14 and guardrail beam 12. Recent trends in guardrail systems include increasing the depth of offset blocks to prevent post snagging. When a frangible or yielding post such as support post 14 is used to support the guardrail beam, however, the offset block need only prevent contact between the guardrail beam and post flanges.

In the absence of an offset or spacer block, a flange protector may be positioned at the interface of the guardrail beam and support post. The flange protector may extend beyond the edges of both the post and the rail element to shield the rail element from the edges of the support post and, thus, prevent initiation of cuts or tears in the guardrail beam in the vicinity of the support post as the guardrail system deforms during an impact. The flange protector may take the form of a plate fabricated from metal, wood, plastic, rubber elastomer, or composite materials. When used in conjunction with a corrugated rail element, such as a W-shaped corrugated member or a thrie beam, the plate may be fabricated to conform to the shape of the rail element such that it can nest inside the rail element. The dimensions of the plate are such that the edges of the plate extend to or beyond the edges of the support post.

Figure 10A:
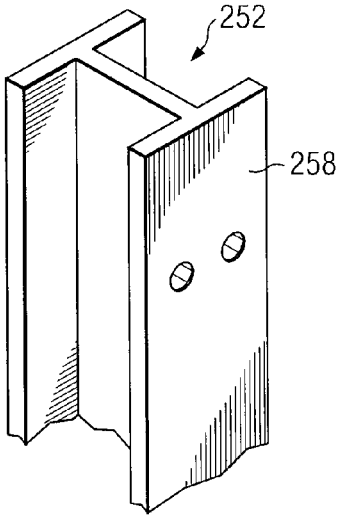
FIGS. 10A and 10B illustrate a flange protector for attachment to a support post for the protection of a guardrail beam, in accordance with one embodiment of the present invention.
Figure 10B:
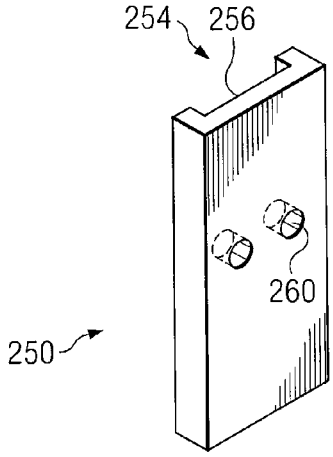

FIGS. 10A and 10B illustrate a flange protector 250 for attachment to a support post 252. Flange protector 250 is a modification of standard offset blocks and serves to prevent tearing of the guardrail beam during impact. Because flange protector 250 is a much smaller spacer than standard offset blocks, flange protector 250 may be incorporated into a guardrail system at a lower cost than a standard offset block. Although flange protector 250 may be comprised of plastic, in preferred embodiments, it is generally recognized that flange protector 250 may be alternatively made of wood, metal, rubber elastomer, composite materials, or any combination of these or other suitable materials.

Flange protector 250 includes a body portion that is substantially rectangular. In particular embodiments, flange protector 250 may comprise a substantially flat plate. In other embodiments and in the illustrated embodiment, flange protector 250 includes an indentation 254 in the a first surface 256 that is proximate to support post 252 when the flange protector 250 and support post 252 are assembled together. Specifically, when assembled together, a flange 258 of support post 252 that is proximate flange protector 250 fits into indentation 254. Accordingly, the dimensions of flange protector 250 and the size of indentation 254 may vary as is appropriate for the particular size and shape of support post 252. It is generally recognized, however, that indentation 254 is optional, and flange protector 250 may or may not include such an indentation.

In various embodiments, the depth of flange protector 250 may be selected based on the depth of support post 252. For example, in a particular embodiment, the depth of flange protector 250 may be selected to be less than the predetermined depth of the support post and may be selected to be less than half of the predetermined depth of the support post. As another example, the depth of flange protector 252 may be selected to be less than three inches.

In particular embodiments, for example, where support post 252 includes a W6×8.5 Wide flange, flange protector 250 may have a length on the order of approximately 360 millimeters (14.17 inches) and a width on the order of approximately 131 millimeters (5.16 inches). The depth of flange protector 250 may vary within a range on the order of approximately 13 to 62 millimeters (0.5 to 2.4 inches). Indentation 254 in first surface 256 may have a depth of approximately 10 millimeters (0.39 inches), in a particular embodiment. Thus, lips on either side of flange protector 250 may be raised approximately 10 millimeters (0.39 inches) to protect the guardrail beam from the edges of the abutted flange 258 of support post 252 and to keep flange protector 250 from rotating once connected to support post 252. The width of the lips on either side of indentation 254 may be on the order of approximately 13 millimeters (0.5 inches). For connection between support post 252 and the guardrail beam (not shown), flange protector 250 includes one or more boltholes 260 that are approximately 21 millimeters (0.82 inches) in diameter, in the illustrated embodiment.

The dimensions of flange protector 250 may also be varied. Thus, the dimensions provided above are for example purposes only. In some embodiments, the depth of flange protector may be bigger or smaller than the provided range of 13 to 62 millimeters (0.5 to 2.4 inches). The combination of flange protector 250 with the frangibility of support post 252 in a LON section of guardrail system 10 may provide enhanced impact performance and reduced installation cost. Specifically, a flange protector 250, as an alternative to the standard offset block, may cost much less than the cost of a deep offset block and may be attractive to a number of highways and roads agencies where it is anticipated that the omission of both may result in a system with an increased potential for incidence of rupture of the guardrail beam when contacted with flange 258 of support post 252.

As described above, flange protector 250 shields the guardrail beam from the sharp edges of support post 252 to prevent rupturing of the guardrail beam. Thus, anywhere it is desirable to protect the guardrail beam from the flanges of support posts, a flange protector 250 may be used. As an additional variation, it is recognized that support post may in particular embodiments include a structural member that of a different cross-sectional shape than that described. For example, and as discussed above, support post may comprise a rectangular, a tubular member, or any other appropriate shape. Where support post does not include flanges such as flanges 258, it is recognized that flange protector may be selected to accommodate the selected cross-sectional shape of the support post and may be termed "a guardrail beam protector."

Figure 11A:
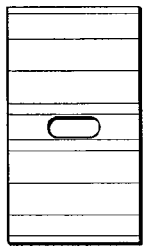
FIGS. 11A and 11B illustrate a flange protector for use with a corrugated rail element, in accordance with one embodiment of the present invention.
Figure 11B:
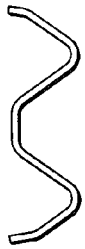

As described above, when used in conjunction with a corrugated rail element, such as a W-shaped corrugated member or a thrie beam, the plate may be fabricated to conform to the shape of the rail element such that it can nest inside the rail element. FIGS. 11A and 11B illustrate side and profile views, respectively, of a flange protector 270 that may be used in conjunction with corrugated rail elements, in accordance with a particular embodiment of the present invention. Similar to flange protector 250 of FIG. 10B, flange protector 270 may prevent the rupturing of the guardrail beam by the sharp edges of the LON support post flanges. In general, flange protector 270 is coupled between the support post and the guardrail beam.

As illustrated, flange protector 270 has a depth on the order of approximately 312 millimeters (12.3 inches) and a width of approximately 152 millimeters (6 inches). Flange protector 270 includes a body portion that is substantially W-shaped similar to terminal guardrail portion 12*a*. Thus, in particular embodiments, flange protector 270 includes two corrugations. Such a configuration may be used to mate to a W-shaped guardrail beam (such as terminal guardrail portion 12*a*), a transition guardrail beam (such at transition guardrail portion 12*b*), or a thrie guardrail beam (such as LON guardrail portion 12*c*). Specifically, where assembled between a support post and a W-shaped guardrail beam, flange protector 270 may lie substantially flush with the W-shaped guardrail beam. In other embodiments, where the flange protector 270 is assembled between a support post and a thrie-shaped guard rail beam, the bottom edge of the flange protector 270 may correspond generally with the bottom edge of the thrie guard rail beam. As a result the two corrugations of the flange protector 270 may lie substantially flush with the lower two corrugations of the thrie guardrail element. As described above, the upper corrugation of the thrie guardrail element may be unsupported by a support post in some embodiments. In such instances, a third corrugation on flange protector 270 may be unnecessary.

It is generally recognized, however, that the provided flange protector is merely one example of a flange protector that may be used in a guardrail system such as guardrail system 10 of FIG. 1. Accordingly, it is recognized that in some embodiments, it may be desirable to use a flange protector having a configuration similar to a thrie beam. Thus, in particular embodiments, flange protector 270 may be replaced with a similar flange protector having three corrugations. Such a configuration may be particularly appropriate for use with a thrie beam guard rail element, such as LON guardrail portion 12*c* of guardrail system 10, where the LON support posts extend to the same or a greater elevation than the top elevation of the thrie beam element. Accordingly, it is generally recognized that the size and shape of flange protector 270 may vary as is appropriate for the particular support post and guardrail beam element used in the guardrail system.

For connection between the support post and the guardrail beam element, flange protector 270 includes one or more boltholes 272 that are approximately 0.875 inches in diameter, in the illustrated embodiment. Although flange protector 270 may be comprised of steel, in preferred embodiments, it is generally recognized that flange protector 270 may be alternatively made of plastic, wood, composite materials, or any combination of these or other suitable materials.

The dimensions of flange protector 270 may also be varied depending on post size and type and on guardrail type. The combination of flange protector 270 with the frangibility of the support post may provide enhanced impact performance and reduced installation cost. Specifically, a flange protector 270, as an alternative to the standard offset block, may cost much less than the cost of a deep offset block and may be attractive to a number of highways and roads agencies where it is anticipated that the omission of both may result in a system with an increased potential for incidence of rupture of the guardrail beam when contacted with the flanges of the support post.

Returning to FIG. 1, guardrail beam 12 is attached to support posts 14 with connectors (not shown). The connectors may be threaded or inserted through bolt holes formed through support posts 14 and corresponding bolt holes formed through guardrail beam 12. Oversized guardrail nuts may be used on the back side of the support post 14 flange. Bolt holes formed through support posts 14 were illustrated and described above with respect to FIGS. 4A-4C, 5A-5C, 6A-6C, 7A-7C, and 8A-8C and were identified by reference numerals 48, 74, 110, 184, and 188, respectively.

It is desirable for the connectors to sufficiently support guardrail beam 12 but to be readily released upon load being directly applied to support post 14 or upon deflection of the rail element and rotation of the support post in surrounding soil. For example, the connectors may enable support posts 14 to readily release from guardrail beam 12 when support post 14 is contacted by a vehicle. In some instances, coupling the support post with the guardrail beam using two connectors may provide too much connective force and prevent the desired decoupling. Accordingly, it may be desirable in some instances to provide a single connector.

Figure 12:
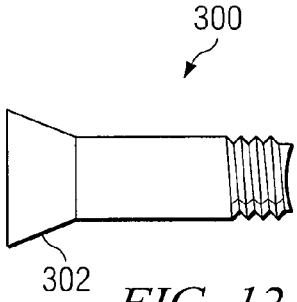
FIG. 12 illustrates a connector for coupling a guardrail beam with a support post, in accordance with a particular embodiment of the present invention.

FIG. 12 illustrates an example of a connector 300 for coupling a guardrail beam 12 with a yielding support post 14, such as a terminal support post 14*a*, transition support post 14*b*, or a LON support post 14*c*. The configuration of connector 300 is such as to provide sufficiently weak connection between guardrail beam 12 and support post 14 so that support post 14 detaches from guardrail beam 12 when the guardrail is struck by an errant vehicle. As a result, guardrail beam 12 remains substantially at its original height after impact and the errant vehicle may be prevented from driving over the guardrail beam 12 and further leaving the roadway or becoming unstable.

In particular embodiments, connector 300 includes a bolt with a tapered or wedge-shaped head 302, such as a countersunk bolt. Connector 300 provides sufficiently low force against guardrail beam 12 to release support post 14 from guardrail beam 12 when an errant vehicle contacts and displaces support post 14 or upon deflection of the rail element and rotation of the support post in surrounding soil. Stated differently, the connection formed between guardrail beam 12 and support post 14 by connector 300 is strong in shear and weak in tension. The shape of countersunk head 302 allows connector 300 to pull through the mounting slot on the guardrail beam 12. Connector 300 may then be displaced with support post 14 upon impact.

Such a connector is improved over oval shoulder button head bolts that provide adequate support for the guardrail beam but do not provide sufficiently low release strength. Connector 300 is also improved over small diameter bolts, which are typically used with several washers. Small diameter bolt-washer combinations provide only a limited ability to support the guardrail beam (not strong in shear) and have variable release strengths due to their dependence on material properties of bolts or washers.

In a particular embodiment, connector 300 may include slotted countersunk bolts such as, for example, 16 millimeters (⅝-inch) diameter by 38 millimeters (1½-inch) long slotted flat countersunk head machine screws. The countersunk head 302 of connector 300, in such an embodiment, may have a diameter on the order of approximately 25 millimeters (1 inch) and have a length on the order of 13 millimeters (½ inch). Other embodiments may include a countersunk head 302 having a diameter on the order of 25 millimeters (1 inch) and a length on the order of 7 millimeters (¼ inch) thereby creating a steeper taper angle. It is generally recognized, however, that these are merely two examples of connectors 300 that may be used to releasably engage guardrail beam 12 with support post 14. Other connectors that may be used in place of connector 300 include those specified by ANSI/ASME B18.5. For example, in certain embodiments, a 1.75 inch ANSI/ASME B18.5 Grade 2, slotted counter sunk bolt having unified coarse threads on the order of 11 threads per inch may be used.

Still other, alternative embodiments of possible connectors may include appropriately sized standard bolts that will tear through the guardrail beam without rupturing the guardrail beam. For example, the standard bolts may be selected such that a head portion of the bolt is of a size that overlaps an edge of the aperture by a distance that generates a desired pullout resistance. In particular embodiments, the size of the head portion may be selected as a function of a thickness of the guardrail beam. Such bolts may include ⅝-inch bolts, ¼-inch bolts, or 3/16-inch bolts with or without washers. A plow bolt may also be used where the resulting connection is weak in tension such as to release when a lateral load is applied. In still other embodiments, connector 300 may release through fracture, shear, or tensile failure.

Figure 13A:
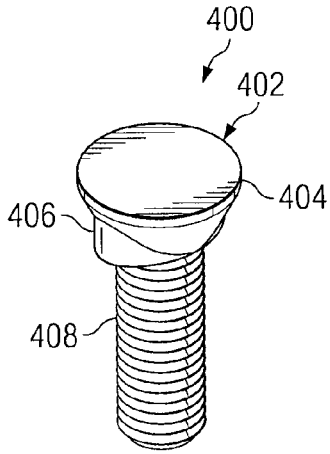
FIGS. 13A-13C illustrate a connector for coupling a guardrail beam with a support post, in accordance with an alternative embodiment of the present invention.
Figure 13B:
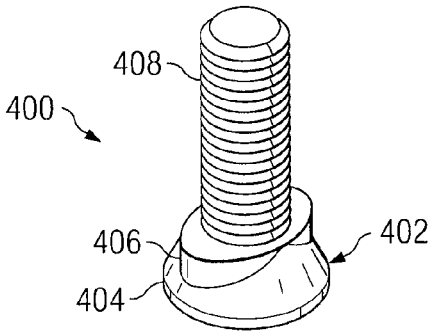
Figure 13C:
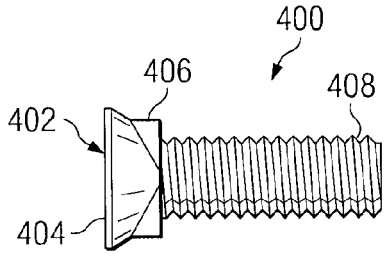

FIGS. 13A-13C illustrate another example of a connector 400 for coupling a guardrail beam 12 with a yielding support post 14, such as a terminal support post 14*a* or a LON support post 14*c*. Like connector 300, connector 400 includes a bolt with a tapered or countersunk head 402 to provide adequate support of guardrail beam 12. Connector 400 provides sufficiently low force against guardrail beam 12, to release support post 14 from guardrail beam 12 when an errant vehicle contacts and displaces support post 14 or upon deflection of the rail element and rotation of the support post in surrounding soil. Stated differently, connector 400 forms a connection between guardrail beam 12 and support post 14 that is strong in shear and weak in tension. The shape of countersunk head 402 allows connector 400 to pull through the mounting slot on the guardrail beam 12. Connector 400 may then be displaced with support post 14 upon impact.

Additionally, the configuration of connector 400 prevents connector 400 from rotating when connector 400 is used to couple support post 14 with guardrail beam 12. Specifically, head 402 of connector 400 includes a first surface 404 and a second surface 406. Whereas first surface 404 comprises the outer surface of connector 400, second surface 406 is proximate threaded shaft 408. In the illustrated embodiment, first surface 404 of head 402 is of a substantially round configuration. By contrast, second surface 406 is of a substantially oval configuration and forms a shoulder of head 402 that is proximate threaded shaft 408. Where guardrail beam 12 includes a slotted hole through which connector 400 is placed, the oval shape of shoulder 406 prevents connector 400 from rotating in the slotted hole, which permits it to be tightened without the need for slotting the head of connector 400. The shoulder 406 of connector 400 also limits the horizontal movement of connector 400 within the slotted hole of guardrail beam 12. This, in turn, limits the amount of overlap of head 402 of connector 400 with the edge of the slotted hole of guardrail beam 12. The result is that the pullout force required to disengage connector 400 from guardrail beam 12 is further reduced.

In a particular embodiment, connector 400 may include slotted countersunk bolts such as, for example, 16 millimeters (⅝-inch) diameter by 38 millimeters (1½-inch) slotted flat countersunk head machine screws. The countersunk head 402 of connector 400, in such an embodiment, may have a diameter on the order of approximately 25 millimeters (1 inch) and have a length on the order of 13 millimeters (½ inch). The diameter of the longer dimension of oval shoulder 406 may correspond generally with the diameter of head 402 or approximately 1 inch, and the diameter of the shorter dimension of oval shoulder 406 may correspond generally with the diameter of the bolt shaft or approximately ⅝ inch. It is generally recognized, however, that this merely one example of a connectors 400 that may be used to releasably engage guardrail beam 12 with support post 14. Other connectors may be used in place of connector 400.

Figure 14A:
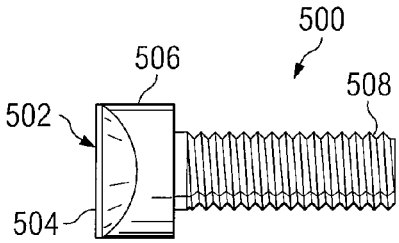
FIGS. 14A-14C illustrate a connector for coupling a guardrail beam with a support post, in accordance with an alternative embodiment of the present invention.
Figure 14B:
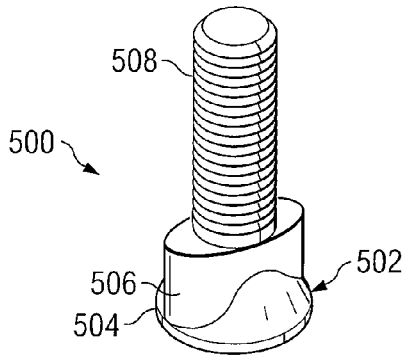
Figure 14C:
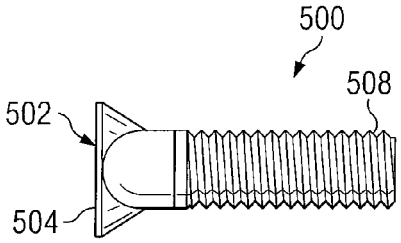

FIGS. 14A-14C illustrate another example of a connector 500 for coupling a guardrail beam 12 with a yielding support post 14, such as a terminal support post 14*a* or a LON support post 14*c*. Like connectors 300 and 400, connector 500 includes a bolt with a countersunk head 502 to provide adequate support of guardrail beam 12. Connector 500 provides sufficiently low force against guardrail beam 12, to release support post 14 from guardrail beam 12 when an errant vehicle contacts and displaces support post 14 or upon deflection of the rail element and rotation of the support post in surrounding soil. Stated differently, connector 500 forms a connection between guardrail beam 12 and support post 14 that is strong in shear and weak in tension. The shape of countersunk head 502 allows connector 500 to pull through the mounting slot on the guardrail beam 12. Connector 500 may then be displaced with support post 14 upon impact.

Like connector 400, the configuration of connector 500 prevents connector 500 from rotating when connector 500 is used to couple support post 14 with guardrail beam 12. Specifically, head 502 of connector 500 includes a first surface 504 and a second surface 506. Whereas first surface 504 is of a substantially round configuration, second surface 506 is of a substantially oval configuration and forms a shoulder of head 502 that is proximate threaded shaft 508. Where guardrail beam 12 includes a slotted hole through which connector 500 is placed, the oval shape of shoulder 506 prevents connector 500 from rotating in the slotted hole when being tightened. The shoulder 506 of connector 500 also limits the horizontal movement of connector 500 within the slotted hole of guardrail beam 12. This, in turn, limits the amount of overlap of head 502 of connector 500 with the edge of the slotted hole of guardrail beam 12. The result is that the pullout force required to disengage connector 500 from guardrail beam 12 is further reduced.

In the illustrated embodiment, connector 500 may include slotted countersunk bolts such as, for example, 16 millimeters (0.625 inch) diameter by 51 millimeters (2-inches) slotted flat countersunk head machine screws. The countersunk head 502 of connector 500, in such an embodiment, may have a diameter on the order of approximately 25 millimeters (1 inch). The diameter of the longer dimension of oval shoulder 506 may correspond generally with the diameter of head 502 or approximately 25 millimeters (1 inch), and the diameter of the shorter dimension of oval shoulder 506 may correspond generally with the diameter of the bolt shaft or approximately 16 millimeters (0.625 inches). It is generally recognized, however, that this merely one example of a connectors 500 that may be used to releasably engage guardrail beam 12 with support post 14. Other connectors may be used in place of connector 500.

As shown, the head 502 of connector 500 is longer than the head 402 of connector 400. The length of oval shoulder 506 bears against the flange of the support post where such a support is used. The increased length of oval shoulder 506 allows head 502 of connector 500 to accommodate the thicknesses of the flange and a flange protector. As a result, countersunk head 502 limits the clamping force that can be applied to guardrail beam 12 during tightening of connector 500. Additionally, the slope of first surface 504 is increased to an angle of approximately 60 degrees. The larger gentler slope of the connector head 502 allows connector 500 to pull through the flange and flange protector more readily than a greater slope such as that illustrated with regard to connector 400.

Figure 15A:
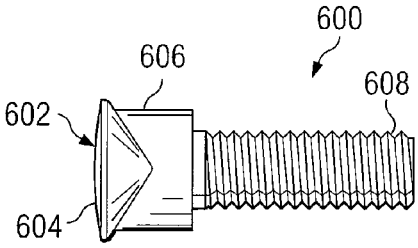
FIGS. 15A-15C illustrate a connector for coupling a guardrail beam with a support post, in accordance with an alternative embodiment of the present invention.
Figure 15B:
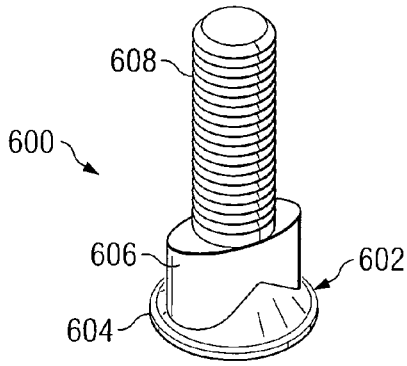
Figure 15C:
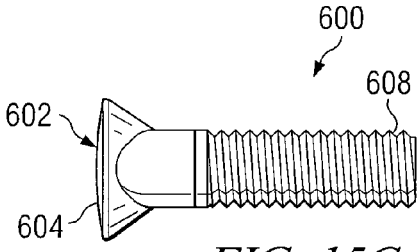

FIGS. 15A-15C illustrate yet another example of a connector 600 for coupling a guardrail beam 12 with a yielding support post 14, such as a terminal support post 14*a* or a LON support post 14*c*. Like connectors 300, 400, and 500, connector 600 includes a bolt with a countersunk head 602 to provide adequate support of guardrail beam 12. Connector 600 provides sufficiently low force against guardrail beam 12, to release support post 14 from guardrail beam 12 when an errant vehicle contacts and displaces support post 14 or upon deflection of the rail element and rotation of the support post in surrounding soil. Thus, connector 600 is configured to operate similar to connectors 400 and 500, discussed above.

In the illustrated embodiment, however, connector 600 may includes slotted countersunk bolts such as, for example, 16 millimeters (0.625 inch) diameter by 51 millimeters (2-inches) slotted domed countersunk head machine screws. The countersunk head 602 of connector 600, in such an embodiment, may have a diameter on the order of approximately 26 millimeters (1.025 inches). The diameter of the longer dimension of oval shoulder 606 may correspond generally with the diameter of head 602 or approximately 26 millimeters (1.025 inches), and the diameter of the shorter dimension of oval shoulder 606 may correspond generally with the diameter of the bolt shaft or approximately 16 millimeters (0.625 inches). It is generally recognized, however, that this merely one example of a connectors 600 that may be used to releasably engage guardrail beam 12 with support post 14. Other connectors may be used in place of connector 600.

As shown, the head 602 of connector 600 is longer than the head 402 of connector 400. The length of oval shoulder 606 bears against the flange of the support post where such a support is used. The increased length of oval shoulder 606 allows head 502 of connector 500 to accommodate the thicknesses of the flange and a flange protector. As a result, countersunk head 602 limits the clamping force that can be applied to guardrail beam 12 during tightening of the connector 600. Like first surface 504 of connector 500, the slope of first surface 604 is increased to an angle of approximately 60 degrees. The larger gentler slope of the connector head 602 allows connector 600 to pull through the flange and flange protector more readily than a greater slope such as that illustrated with regard to connector 400.

Technical advantages of particular embodiments of the present invention include a guardrail safety system incorporating a guardrail beam having a varied height above the earth's surface along the length of the guardrail beam. Additionally, the multi-level guardrail beam may be supported by a guardrail support post having sufficient strength to redirect vehicles that collide along the length of the guardrail system at an angle to the flow of traffic. In particular, the modified support post, as used in a length-of-need portion of a guardrail system mitigates the severity of the interaction (snagging) between an impacting vehicle and the post without changing the deflection characteristics of the guardrail system. For example, the support posts configured to include a weakened section may release from the guardrail beam upon impact. As a result, the flanges of the support posts may be prevented from tearing the guardrail beam. Still another advantage may include the removal or reduction in size of an offset block in particular embodiments. Accordingly, a guardrail system of the present invention may provide benefits in terms of space and cost savings.

At least four types of guardrail support members are described and illustrated within this specification: (I) W6×9 Wide flanges; (II) W8×10 Wide flanges; (III) W6×8.5 Wide flanges; and (IV) weakened wood posts. It should be recognized by those of ordinary skill in the art that practically any size guardrail support post may be enhanced by incorporating the teachings of the present invention. The size, weight and configuration of the support post are just a few factors to be considered to determine the appropriate location of cutouts, to allow yielding along the weak axis while maintaining sufficient strength along the strong axis to redirect impacting vehicles.

Although the illustrated systems are described as including a single guardrail beam, it may be advantageous for some guardrail systems to include two thrie guardrail beams coupled to opposing sides of the support posts. Such a configuration may be particularly suitable for a median configuration where it is desirable to provide a mechanism for deterring traffic on both sides of the guardrail system. Because guardrail beams are coupled to opposing sides of a single support post, the guardrail system requires less real estate than two single-guardrail beams systems that are abutted to one another. Real estate can get very tight in median areas and along some road sides. The configuration of provides an advantageous configuration in such instances by redirecting errant traffic on either side of the guardrail system.

Although the present invention has been described by several embodiments, various changes and modifications may be suggested to one skilled in the art. It is intended that the present invention encompass such changes and modifications as fall within the scope of the present appended claims. For example, the features described above may be used independently and/or in combination with each other or other design modifications. Changes in the size or strength of the bolts connecting the rail to the offset blocks or flange protectors and support posts and the hole/slot pattern in the rail through which these connecting bolts pass may be varied in any manner suitable for enabling the post to release from the guardrail element.

What is claimed is:

1. A guardrail safety system, comprising:

a guardrail beam operable to contain and redirect an errant vehicle to prevent the vehicle from leaving a roadway, the guardrail beam comprising a thrie beam;

a support post coupled to the guardrail beam, the support post comprising:

a lower portion for installing below grade adjacent the roadway;

a mid portion that lies substantially adjacent the grade, the mid portion including a weakened section operable to weaken the support post about a first axis without substantially weakening the support member about a second axis that is generally perpendicular to the first axis; and an upper portion releasably coupled to the guardrail beam such that the upper portion is uncoupled from the guardrail beam when the mid portion yields about the first axis; and a connector for coupling the support post to the guardrail beam, the connector comprising:

a threaded shaft;

a head portion coupled to the threaded shaft; and a shoulder portion proximate the threaded shaft and configured to prevent the connector from rotating relative to the guardrail beam.

2. A guardrail safety system, comprising:

a guardrail beam operable to contain and redirect an errant vehicle to prevent the vehicle from leaving a roadway, the guardrail beam comprising:

a terminal portion comprising a corrugated guardrail member having two corrugations;

a length-of-need portion comprising a corrugated guardrail member having three corrugations; and a transition portion comprising a steel member that transitions from a corrugated guardrail member having two corrugations to a corrugated guardrail member having three corrugations; and a plurality of guardrail support posts in spaced apart relation to one another, at least a portion of the plurality of support posts comprising:

a lower portion for installing below grade adjacent the roadway;

a mid portion that lies substantially adjacent the grade, the mid portion including a weakened section operable to weaken the support post about a first axis without substantially weakening the support member about a second axis that is generally perpendicular to the first axis; and an upper portion releasably coupled to the guardrail beam such that the upper portion is uncoupled from the guardrail beam when the mid portion yields about the first axis.

3. The guardrail safety system of claim 2, wherein the weakened section comprises at least one aperture selected from the group consisting of a square, rectangle, circle, oval, ellipse, and trapezoid.

4. The guardrail safety system of claim 2, wherein the weakened section comprises at least one cutout selected from the group consisting of a notch, a diamond-shaped notch, a semi-circle opening, and a sawcut.

5. The guardrail safety system of claim 2, wherein at least a portion of the plurality of support posts are comprised of material selected from the group consisting of steel, wood, and plastic.

6. The guardrail safety system of claim 2, wherein at least a portion of the plurality of support posts are comprised of steel and are selected from the group consisting of an I-beam, an H-beam, a C-channel, an S-beam, a W-beam, an M-beam, a square tube, a rectangular tube, or a round tube.

7. The guardrail safety system of claim 6, wherein at least a portion of the plurality of support posts are comprised of steel and are selected from the group consisting of a W6×9 Wide flange, a W8×10 Wide flange, and a W6×8.5 Wide flange.

8. The guardrail safety system of claim 2, further comprising a flange protector coupled between a selected one of the plurality of support posts and the guardrail beam, the flange protector selected from the group consisting of a corrugated guardrail member having two corrugations, a corrugated guardrail member having three corrugations, a flat plate, a block, or a channel.

9. The guardrail safety system of claim 2, further comprising a connector for coupling a selected one of the plurality of support posts to the guardrail beam, the connector comprising a countersunk head having a tapered head portion.

10. The guardrail safety system of claim 2, further comprising a connector for coupling a selected one of the plurality of support posts to the guardrail beam, the connector comprising a bolt having a countersunk head defined by a first surface and a second surface, the countersunk head having a tapered side between the first and second surfaces.

11. The guardrail safety system of claim 2, further comprising a connector for coupling the support post to the guardrail beam, the connector comprising:

a threaded shaft;

a head portion coupled to the threaded shaft; and a shoulder portion proximate the threaded shaft and configured to prevent the connector from rotating relative to the guardrail beam.

12. A guardrail safety system, comprising:

a guardrail beam operable to contain and redirect an errant vehicle to prevent the vehicle from leaving a roadway, the guardrail beam comprising:

a terminal portion comprising a corrugated guardrail member having two corrugations;

a length-of-need portion comprising a corrugated guardrail member having three corrugations; and a transition portion comprising a steel member that transitions from a corrugated guardrail member having two corrugations to a corrugated guardrail member having three corrugations;

a plurality of guardrail support posts in spaced apart relation to one another, at least a portion of the plurality of support posts comprising:

a lower portion for installing below grade adjacent the roadway;

a mid portion that lies substantially adjacent the grade, the mid portion including a weakened section operable to weaken the support post about a first axis without substantially weakening the support member about a second axis that is generally perpendicular to the first axis, the weakened section selected from the group consisting of at least one aperture, at least one notch, and at least one sawcut; and an upper portion releasably coupled to the guardrail beam such that the upper portion is uncoupled from the guardrail beam when the mid portion yields about the first axis;

a flange protector coupled between a selected one of the plurality of support posts and the guardrail beam, the flange protector comprising a portion of a corrugated guardrail beam; and a connector for coupling the selected one of the plurality of support posts to the guardrail beam, the connector comprising a bolt having a countersunk head defined by a first surface and a second surface, the countersunk head having a tapered side between the first and second surfaces.

* * * * *